US006951103B2

(12) United States Patent
Berthod et al.

(10) Patent No.: US 6,951,103 B2
(45) Date of Patent: Oct. 4, 2005

(54) HYDRAULIC CONTROL ARRANGEMENT FOR A MOBILE OPERATING MACHINE

(75) Inventors: Emmanuel Berthod, Arc les Gray (FR); Philippe Ostermann, Gray (FR)

(73) Assignee: Deere & Company, Moline, IL (US)

( * ) Notice: Subject to any disclaimer, the term of this patent is extended or adjusted under 35 U.S.C. 154(b) by 110 days.

(21) Appl. No.: 10/601,298

(22) Filed: Jun. 20, 2003

(65) Prior Publication Data

US 2004/0006980 A1 Jan. 15, 2004

(30) Foreign Application Priority Data

Jun. 22, 2002 (DE) ..... 102 27 966

(51) Int. Cl.[7] ..... F15B 1/02
(52) U.S. Cl. ..... 60/413; 60/469
(58) Field of Search ..... 60/403, 406, 413, 60/414, 469

(56) References Cited

U.S. PATENT DOCUMENTS

| | | | | |
|---|---|---|---|---|
| 3,779,017 A | | 12/1973 | Fujisawa | 60/413 |
| 5,195,864 A | * | 3/1993 | Drake et al. | 60/413 |
| 5,333,533 A | * | 8/1994 | Hosseini | 60/469 |
| 5,355,773 A | | 10/1994 | Winkels | 91/452 |
| 5,921,010 A | * | 7/1999 | Schulte et al. | 37/232 |
| 6,357,230 B1 | * | 3/2002 | A'Hearn et al. | 60/413 |
| 2002/0001516 A1 | | 1/2002 | Cook | |

FOREIGN PATENT DOCUMENTS

| | | |
|---|---|---|
| DE | 28 51 478 A | 4/1980 |
| DE | 196 22 762 A | 11/1997 |
| DE | 197 34 658 A | 2/1999 |
| DE | 199 48 973 A | 12/2001 |
| FR | 2052052 | 9/1971 |
| GB | 2044215 A | 11/1980 |
| SU | 1484868 A1 | 7/1989 |

* cited by examiner

*Primary Examiner*—Thomas E. Lazo

(57) ABSTRACT

A tractor-mounted front end loader includes lift boom having a tool, disclosed as a bucket, pivotally mounted to one end of the boom for selected movement by one or more hydraulic adjustment cylinders. A safety valve is associated with one of the pressure chambers of each adjustment cylinder to prevent unintended lowering of the tool in the event a supply-return hose extending between a direction control valve and the adjustment cylinder should rupture. Also connected to this pressure chamber of each adjustment cylinder is an accumulator for providing a damping action. The connection between the pressure chamber and the accumulator is made by rigid tubing, and in one disclosed embodiment, includes a remotely operable on/off valve for selectively coupling the accumulator to the pressure chamber.

6 Claims, 5 Drawing Sheets

64
68
76
64
74
90
70
78
28
72
66
66
28
26
80
62
58
60
54
56

74'
74
64
76
68
68
76
64
78
78
70
72
72
70
28
66
66
28
26
80
62
58
60
54
56
56

88
84
74'
86
74
84
88
86
64
76
68
68
76
64
78
70
72
72
70
78
28
66
66
28
86
26
80
62
88
84
58
60
54
56
56

HYDRAULIC CONTROL ARRANGEMENT FOR A MOBILE OPERATING MACHINE

FIELD OF THE INVENTION

The invention concerns a hydraulic control arrangement for a mobile operating machine with at least one hydraulic cylinder, by means of which an operating tool can be moved, a directional control valve for the control of the path of the pressurized fluid between the pressure chamber of the cylinder, a source of pressurized fluid and a tank, a safety valve inserted between the directional control valve and the pressure chamber of the cylinder that can be opened for the repositioning of the cylinder, and with a pressure accumulator that can be connected with the pressure chamber of the cylinder.

BACKGROUND OF THE INVENTION

Lifting gear, for example, front loaders, are attached to vehicles and are used for lifting and transporting loads. They are provided with hydraulic cylinders for the lifting of the load, and as a rule, also for the pivoting of the load, which are supplied with pressurized hydraulic fluid from a carrier vehicle through removable, flexible hoses. In order to prevent the load from falling down in the case of a broken hose that leads to a fall-off of the pressure in the cylinder holding the load, so-called load retaining or safety valves are used. These valves block the connection between the cylinder and the hose as long as the operator does not initiate any movement of the lifting gear.

Furthermore, it is possible to connect the hydraulic cylinders of the lifting gear with pressure accumulators acting as vibration dampers that are provided on the lifting or lowering side of a cylinder or on both sides (DE 197 34 658 A). Such pressure accumulators are connected at the connecting point on the vehicle side of the safety valves, since as a rule, they are located on the vehicle and are connected by a hose with the safety valve. In order to obtain damping even when the safety valve is turned off, the operator can manually deactivate the safety valve. The operator then assumes the responsibility of not performing any lifting operation. It is also conceivable that the safety valve can be activated as a function of the speed of the vehicle. If the vehicle is operated at a certain speed, a conclusion can be drawn that the vehicle is not operated in a lifting condition, but in a transport condition. Then the pressure accumulator is effective only during the transport operation.

The problem underlying the invention is seen in the need to improve a load lifting arrangement with a safety valve in such a way that a damping of the cylinder is possible, even if the safety valve is turned off or that the safety valve remains effective even with a damped cylinder.

SUMMARY OF THE INVENTION

According to the present invention, there is provided an improved hydraulic control system for a lifting device such as a loader.

An object of the invention is to provide a hydraulic control system which provides damping against travel-generated oscillations of the lifting arms, no matter what the status is of one or more safety valves contained in the system.

To accomplish the object, it is proposed that a pressure accumulator in the control system be connected on the side of the safety valve facing the lift cylinder. In this way, the result is that damping is achieved, even with an active safety valve, that is, a blocked safety valve. Thereby, damping of the operating tool is possible at all times, without the safety valve being manually deactivated or without it being necessary that the operation be conducted at a minimum speed.

The pressure accumulator may be connected with the pressure chamber of the cylinder directly or through a valve that can be blocked, as a rule, one that can be remotely controlled. The valve makes it possible to turn off the pressure accumulator in case that an operator wants to eliminate the effect of the pressure accumulator in order to perform a more exact positioning of the operating tool.

The pressure accumulator is appropriately coupled mechanically and rigidly to the cylinder and/or the safety valve so that it moves with the cylinder and the safety valve and no hoses are required that might be in danger of rupture. The pressure accumulator is preferably connected with the pressure chamber of the cylinder exclusively by means of mechanically rigid connecting elements, such as tubes and the like. Thereby, the risk of hose rupture is avoided that would result in a sudden dropping of a load.

In particular, the line leading to the pressure accumulator may be connected with a second connection to the pressure chamber of the cylinder, whose first connection is connected to the safety valve, but the use of a T-fitting in the line between the safety valve and the pressure chamber is conceivable for the connection of the pressure accumulator or the use of an additional connection of the safety valve or the safety valve block. In another embodiment, the pressure accumulator is integrated into the housing of the cylinder.

BRIEF DESCRIPTION OF THE DRAWINGS

The drawings show four embodiments of the invention that shall be described in greater detail in the following.

DESCRIPTION OF THE PREFERRED EMBODIMENT

Figure 1:
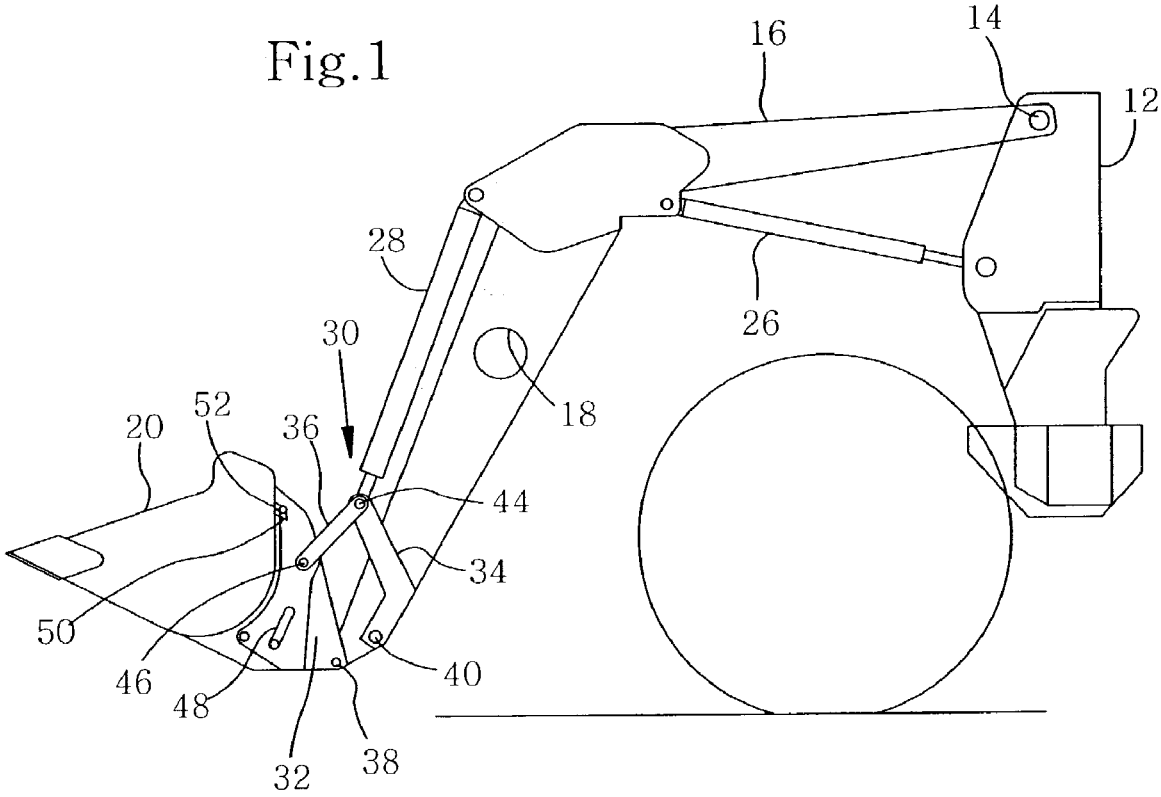
FIG. 1 is a schematic left side view of a lifting gear with an operating tool.

The hydraulic control arrangement, according to the invention, is explained on the basis of the example of an agricultural tractor with a front loader. It can nevertheless be applied to any desired operating machine with movable operating tools, such as wheel loaders, telescoping loaders, dredges, and the like. A lifting gear 10, shown in FIG. 1, is attached to the front side of an agricultural tractor, that is merely indicated, and includes a mast 12 that is illustrated and that engages a lifting boom 16 in a bearing 14. The lifting boom is configured with two arms and therefore is reinforced by means of a transverse carrier 18. An operating tool 20, for example, an earth shovel, a manure fork, a bale fork or a palette fork, is connected to the front end of the lifting boom 16 by means of a positioning arrangement 30 and a tool holder 32 so as to be freely movable and interchangable. In order to lift the operating tool 20, the lifting boom 16 is pivoted about the bearing 14 by means of hydraulic cylinders 26. To reposition the inclination of the operating tool 20, a further hydraulic cylinder 28 engages the repositioning arrangement 30 with one end and the lifting boom 16 with its other end. Further hydraulic cylinders 26 and 28 are respectively arranged on the opposite side of the lifting boom 16 from the side shown. The repositioning arrangement 30 operates on the tool holder 32, to which the operating tool 20 is connected directly, and is composed generally of first and second pivoting arms 34 and 36, respectively, that are connected to each other in a joint 44, with one end of the cylinder 28 being coupled at the joint 44. The tool holder 32 is supported in a bearing 38 on the lifting boom 16, and the first pivot arm 34 is supported in a bearing 40 on the lifting boom 16, in both cases free to pivot.

The second pivot arm 36 is connected in a bearing 46 with the tool holder 32, free to pivot. The number call-out 48 denotes a locking bar that retains the operating tool 20 in a detent position. In the upper section of the tool holder 32, a hook 50 and a pin 52 are provided that bring the operating tool 20 into engagement with the lifting gear 10.

Figure 2:
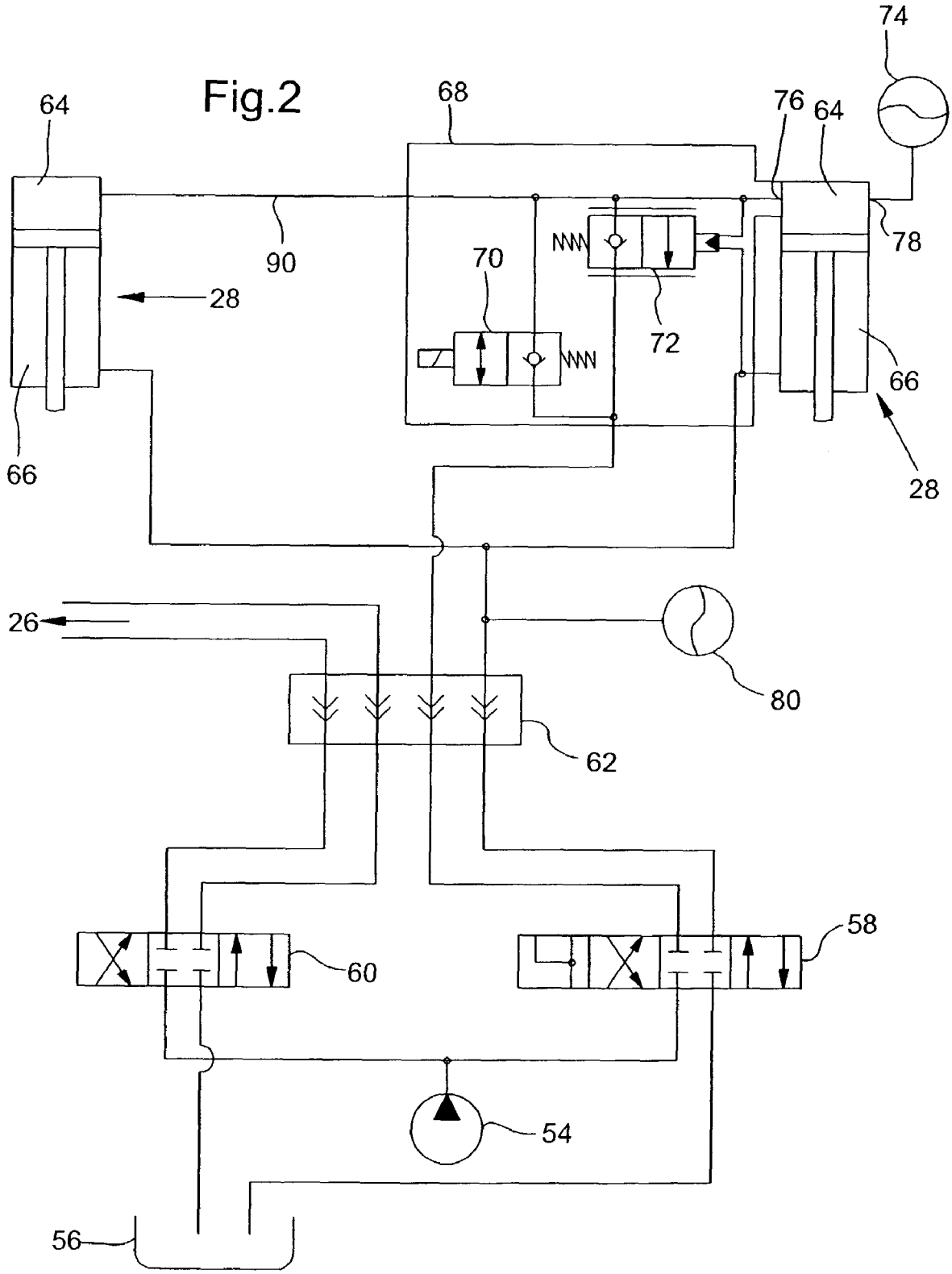
FIG. 2 is a schematic representation of a hydraulic circuit constructed in accordance with a first embodiment of the present invention in which a pressure accumulator is connected with a safety valve and two cylinders.

FIG. 2 shows schematically the hydraulic circuit of a hydraulic control arrangement according to the invention for the operating machine of FIG. 1. On the agricultural tractor, a pump 54 is arranged as a source of pressurized fluid and a tank 56 is arranged to receive return fluid. The pump 54 and tank 56 are both connected over two directional control valves 58 and 60, that can be actuated by the operator from the cab of the agricultural tractor, so as to selectively couple ports of a coupling 62 either to pressurized fluid or to the tank 56. The hydraulic connections of the lifting gear 10 are releasably connected to the coupling 62. The single-acting or double-acting cylinders 26 are connected over the coupling 62 directly with the directional control valve 60 so that the operating tool 20 can be raised or lowered by actuation of the directional control valve 60 in a manner known in itself.

On the other hand, the further cylinders 28 are double-acting. Their piston end pressure chamber 64 is supplied with pressure in order to pivot the operating tool 20 upward. Analogously, its rod end pressure chamber 66 is supplied with pressure when the operating tool 20 is to be pivoted downward. In order to prevent an unintended lowering of the operating tool 20, due to a rupture in a flexible hose coupled between the coupling 62 and a safety valve block 68, which is connected to the piston end pressure chamber 64, the safety valve block 68 is provided with first and second safety valves 70 and 72, respectively. The safety valve block 68 is provided with two connections on the side of the cylinders to each of which a piston end pressure chamber 64 of the cylinders 28 is connected. The safety valves 70 and 72 are provided for each of the two possible directions of flow of the pressurized fluid to and from the chambers 64 and 66. The first safety valve 70 contains a check valve that opens when the pressure in the piston end pressure chamber 64 is lower than the pressure in the associated connection of the coupling 62. It opens automatically when the operator increases the pressure in the piston end pressure chamber 64 by actuating the directional control valve 58. With the use of an electromagnetic remote control, there is the possibility of switching the first safety valve 70 between the check valve and a passage so that the safety valve 70 can be switched to a constant passage flow. The second safety valve 72 also contains a check valve that corresponds to that in the safety valve 70. Under the control of the pressure in the pressure chambers 64 and 66, the second safety valve 72 can switch between the check valve and a passage. Thereby, the passage is opened automatically when the pressure in the rod end pressure chamber 66 is greater than the pressure in the piston end pressure chamber 64, that is, the cylinder 28 should retract so that the pressurized fluid can drain out of the piston end pressure chamber 64 into the tank 56. As a result, the safety valves 70 and 72 are open when the operator initiates a movement of the cylinder 28 over the directional control valve 58, and otherwise are closed.

The piston end pressure chamber 64 of the cylinder 28, shown at the right, is provided with first and second connections 76 and 78, respectively. The first connection 76 is connected with the safety valve block 68. The second connection 78 is connected to a pressure accumulator 74 over rigid connecting elements. The pressure accumulator 74 is fastened mechanically to the lifting boom 16 or to the cylinder 28. The pressure accumulator 74 provides permanent damping for the cylinder 28 shown at the right, and over the first connection 76 and the rigid connection 90 also, for the cylinder 28 shown at the left, even with closed safety valves 70 and 72. The pressure accumulator 74 could also be arranged in the housing of the cylinder 28 near the bottom side.

A second pressure accumulator 80 is connected with the rod end pressure chamber 66 of the cylinders 28, in order to provide further damping of each cylinder 28. Since the rod end pressure chambers 66 are not critical from a safety standpoint as a pressure drop in them does not lead to a lowering of the operating tool 20, safety valves associated with them can be omitted. The second pressure accumulator 80 may be fastened to the lifting boom 16 or to the frame of the agricultural tractor, where flexible hoses can be used.

Figure 3:
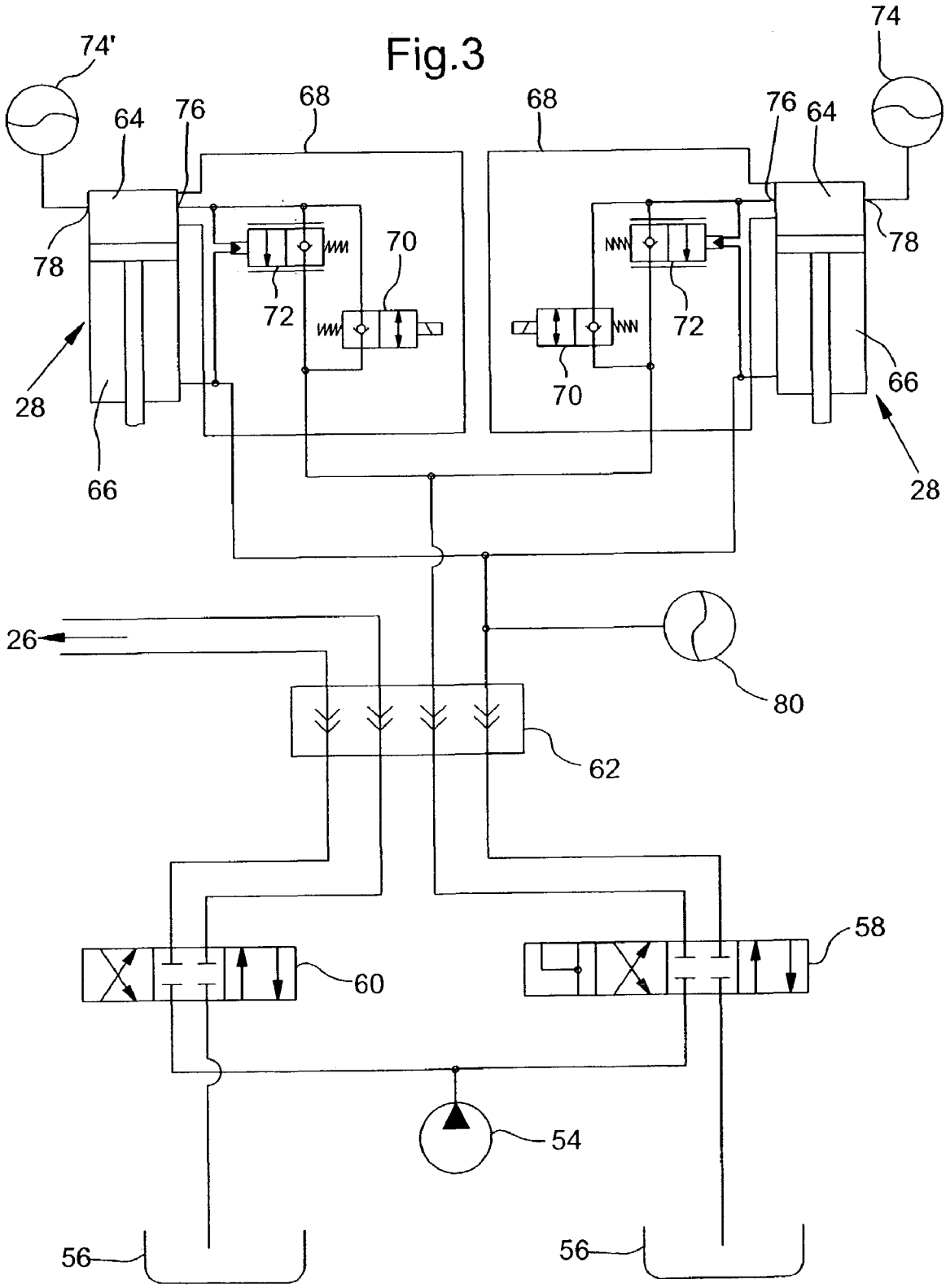
FIG. 3 is a schematic representation of a hydraulic circuit constructed in accordance with a second embodiment of the present invention in which a pressure accumulator is connected with a safety valve and a cylinder.

FIG. 3 schematically shows a second embodiment of a hydraulic circuit of a hydraulic control arrangement. Elements that conform to those of the first embodiment are identified with the same number call-outs. In contrast to the embodiment according to FIG. 2, each of the cylinders 28 is associated with a safety valve block 68. Therefore, each cylinder 28 is also equipped with a second connection 78 and a pressure accumulator 74 and 74', respectively, connected to them. However, for the rod end side of the cylinders 28, only a common pressure accumulator 80 is provided, as in the embodiment according to FIG. 2.

Figure 4:
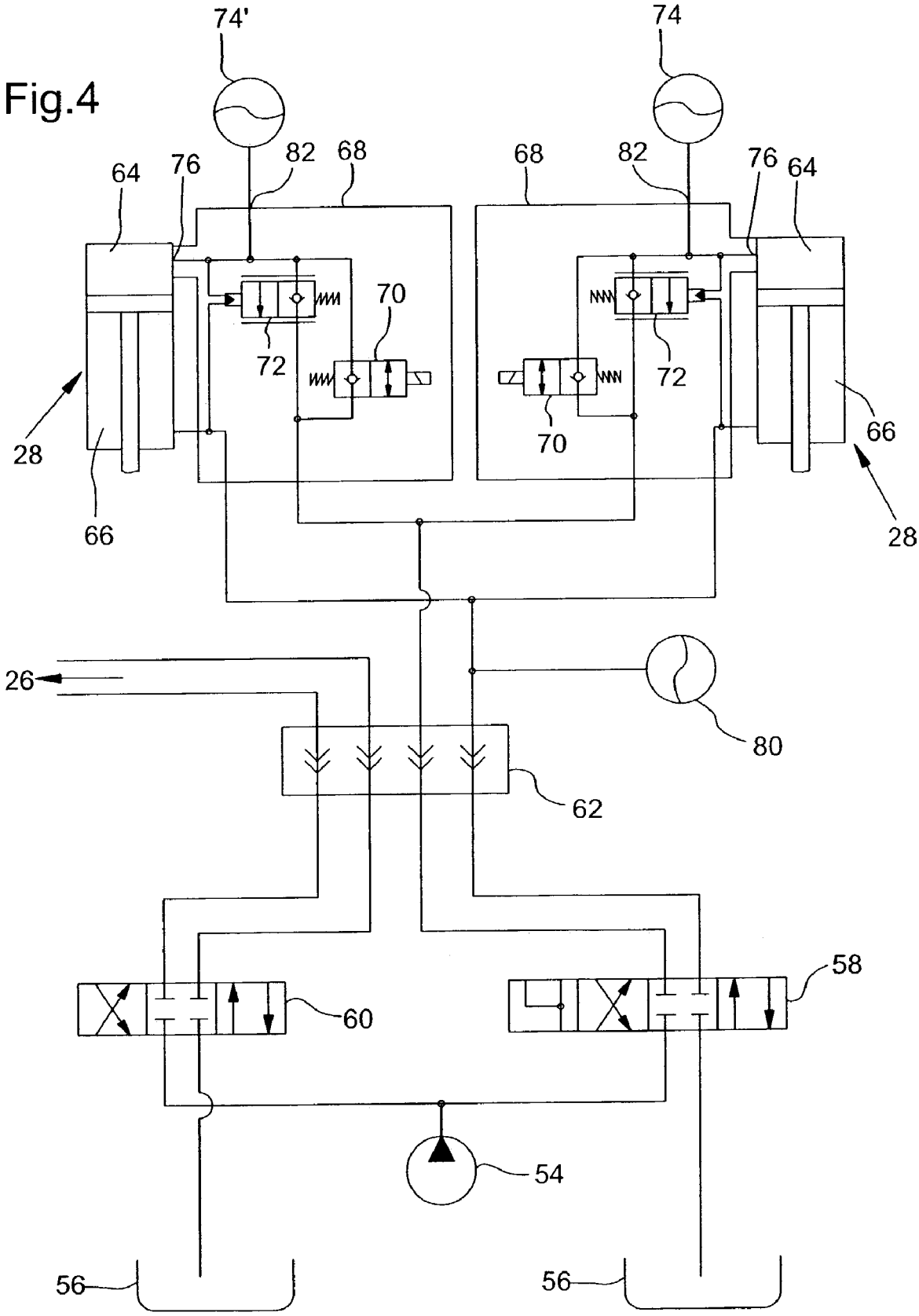
FIG. 4 is a schematic representation of a third embodiment of the present invention in which a pressure accumulator is directly connected with a safety valve.

The third embodiment of a hydraulic control arrangement, according to the invention shown in FIG. 4, differs from that shown in FIG. 3 by the fact that the cylinders 28 are equipped with only a single connection 76, and that the pressure accumulators 74 and 74' are each connected with a connection 82 of the associated safety valve block 68. The connection 82 is connected within the safety valve block 68 with the connection 76. Thereby, the second connection 78 of the cylinders 28 can be omitted.

Figure 5:
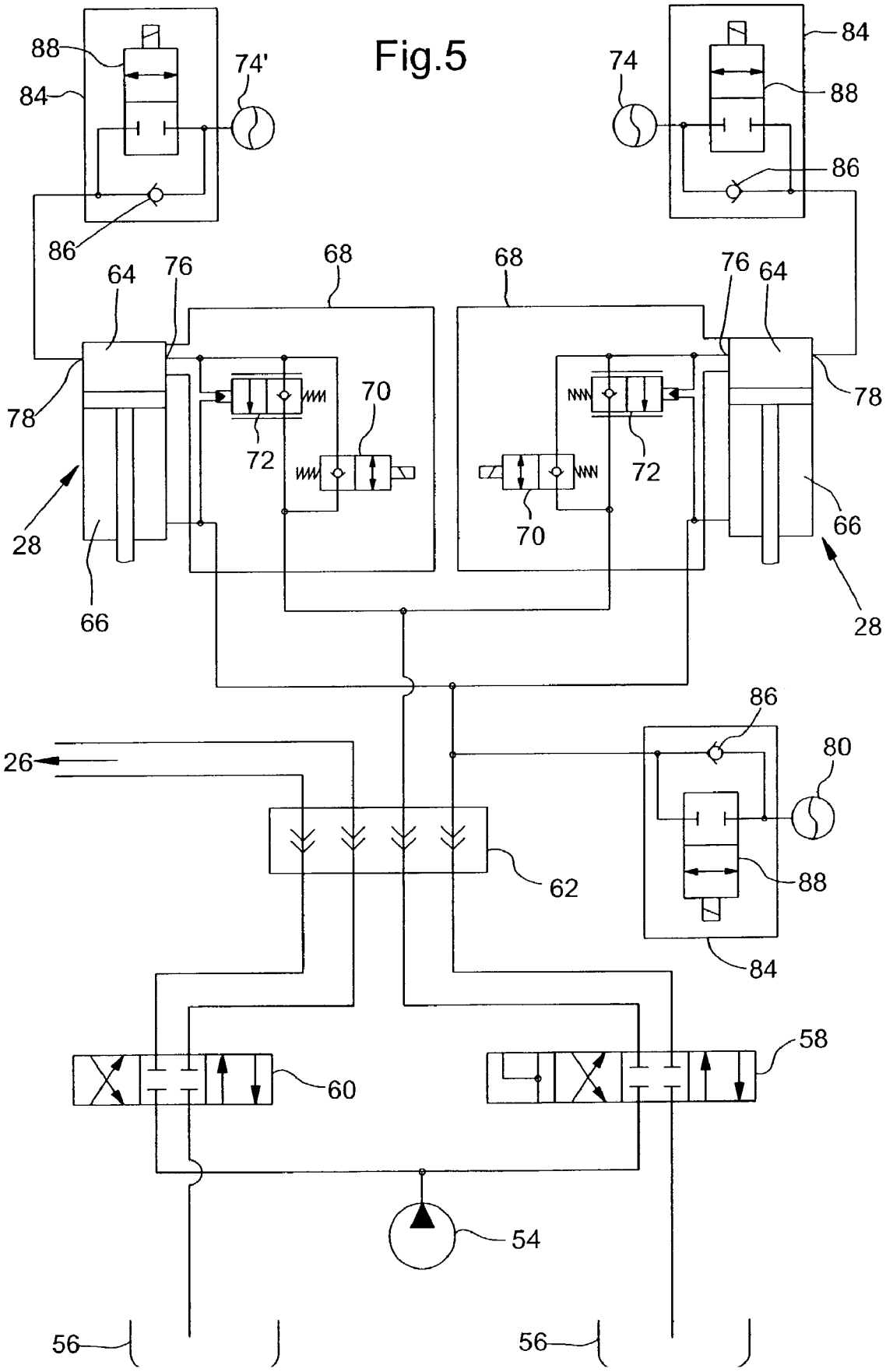
FIG. 5 is a schematic representation of a fourth embodiment of the present invention in which a pressure accumulator that can be blocked, is connected with a safety valve and a cylinder.

FIG. 5 schematically shows a fourth embodiment of a hydraulic control arrangement according to the invention. It corresponds generally to the embodiment according to FIG. 3; however, the pressure accumulators 74, 74' and 80 can be disabled by means of respective valve arrangements 84. The valve arrangements 84 include check valves 86 that open when the pressure in the associated pressure accumulator 74, 74', and 80 is lower than the pressure in the associated cylinder pressure chamber. Thereby, undesirable movements of the cylinders 28 can be avoided when the associated pressure accumulator is turned on. Furthermore, each valve arrangement 84 includes a directional control valve 88 that can be remotely, electromagnetically controlled and that can be moved between a through passage position, in which the pressure accumulators 74, 74', 80 are connected with the associated cylinder pressure chambers, and a blocking position, in which the pressure accumulators are separated from the cylinder pressure chambers. The valve arrangements 84 make it possible to block the pressure accumulators in case the operator desires to reposition the operating tool 20 with increased precision.

It should be noted that in place of, or in addition to, the cylinders 28, the cylinder or the cylinders 26 could also be spring supported by pressure accumulators in the manner shown.

Having described the preferred embodiment, it will become apparent that various modifications can be made without departing from the scope of the invention as defined in the accompanying claims.

What is claimed is:

1. In a hydraulic control arrangement for a mobile operating machine including a lift boom, a tool mounted to an end of said boom for adjustment about a pivot axis, at least one hydraulic cylinder coupled between said boom and said tool for selectively adjusting the tool, a directional control valve coupled to first and second pressure chambers of said hydraulic cylinder for controlling the path of the pressurized fluid between said pressure chambers and a source of fluid pressure and a tank, a safety valve being inserted between said directional control valve and said first pressure chamber of said cylinder for preventing movement of said cylinder in the event of a rupture in a hose connected between said directional control valve and said safety valve, said safety valve including a valve element that can be opened to permit flow to said first pressure chamber so as to reposition said cylinder and a pressure accumulator being connected, or connectible, with said first pressure chamber of said cylinder, the improvement comprising: said pressure accumulator being connected to said first pressure chamber of said cylinder exclusive of any working components of said safety valve; said valve element of said safety valve being a two-position, pressure responsive valve which is normally biased to a first position wherein said valve element blocks fluid flow in the direction of said direction control valve from said first pressure chamber, and which shifts in response to pressure to a second position wherein it establishes a flow path to said direction control valve; said valve element being coupled at least to said first pressure chamber so as to be shifted to said second position in response to an increase in pressure in said first pressure chamber caused by pressurizing said second chamber; and a remotely controllable, two-position second safety valve being coupled in parallel with the first-mentioned safety valve and including a second valve element normally located in a first position blocking fluid flow to said direction control valve from said first pressure chamber, and being selectively movable to a second position establishing a fluid path between said first pressure chamber and said directional control valve, whereby flow to and from said first pressure chamber may be increased by selectively shifting said second valve element to said second position during actuation of said cylinder.

2. The control arrangement, as defined in claim 1, and further including a remotely controllable on/off valve coupled between said pressure accumulator and said first pressure chamber for selectively providing free fluid flow between said pressure accumulator and said first pressure chamber.

3. The control arrangement, as defined in claim 2, wherein a bypass fluid path is provided between said first pressure chamber and said accumulator for providing an alternate route for fluid to follow instead of going through said on/off valve; and said bypass fluid path containing a check valve permitting fluid flow only in the direction of said accumulator.

4. The control arrangement, as defined in claim 1, wherein said pressure accumulator is connected with said first pressure chamber only through mechanically rigid connecting elements.

5. The control arrangement, as defined in claim 1, wherein said safety valve and said pressure accumulator are connected to said pressure chamber at separate locations.

6. The control arrangement, as defined in claim 1, wherein said safety valve includes a valve block having a fluid passage coupled to said first pressure chamber; and said accumulator being connected to said fluid passage exclusive of any working components of said safety valve.

* * * * *